US010662745B2

(12) United States Patent
Tolman et al.

(10) Patent No.: US 10,662,745 B2
(45) Date of Patent: May 26, 2020

(54) PERFORATION DEVICES INCLUDING GAS SUPPLY STRUCTURES AND METHODS OF UTILIZING THE SAME

(71) Applicants: Randy C Tolman, Spring, TX (US); Timothy G. Benish, Spring, TX (US)

(72) Inventors: Randy C Tolman, Spring, TX (US); Timothy G. Benish, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 126 days.

(21) Appl. No.: 16/130,539

(22) Filed: Sep. 13, 2018

(65) Prior Publication Data

US 2019/0153826 A1 May 23, 2019

Related U.S. Application Data

(60) Provisional application No. 62/608,219, filed on Dec. 20, 2017, provisional application No. 62/589,800, filed on Nov. 22, 2017.

(51) Int. Cl.
*E21B 43/116* (2006.01)
*E21B 43/119* (2006.01)

(52) U.S. Cl.
CPC ..... *E21B 43/116* (2013.01); *E21B 43/119* (2013.01)

(58) Field of Classification Search
CPC .... E21B 43/116; E21B 43/117; E21B 43/119; E21B 43/11; E21B 43/112; E21B 43/118
See application file for complete search history.

(56) References Cited

U.S. PATENT DOCUMENTS 2,210,983 A * 8/1940 MacClatchie ..... E21B 43/116 175/4.5
2,210,984 A * 8/1940 MacClatchie ..... E21B 43/116 175/4.5
2,216,359 A 10/1940 Spencer
2,398,868 A 4/1946 Stuart et al.
2,426,517 A * 8/1947 McWhorter ..... E21B 43/116 175/4.5
2,630,067 A * 3/1953 McWhorter ..... E21B 43/1185 175/4.56

(Continued)

FOREIGN PATENT DOCUMENTS

RU 2 160 360 C2 12/2000

*Primary Examiner* — Kipp C Wallace
(74) *Attorney, Agent, or Firm* — ExxonMobil Upstream Research Company—Law Department

(57) ABSTRACT

Perforation devices including gas supply structures and methods of utilizing the same. The perforation devices include a magazine, a barrel, an action, and the gas supply structure. The magazine is configured to contain a plurality of cartridges. The barrel extends between a breech, which is configured to receive a selected cartridge of the plurality of cartridges that includes a selected projectile, and a muzzle, which is configured, upon firing of the selected cartridge, to permit the selected projectile to exit the barrel at a muzzle velocity and with a muzzle trajectory. The action is configured to transfer the selected cartridge from the magazine to the breech of the barrel and to fire the selected cartridge. The gas supply structure is configured to provide a gas stream to the barrel and includes a surface gas source and a gas supply conduit extending between the surface gas source and the barrel.

20 Claims, 10 Drawing Sheets

(56) References Cited

U.S. PATENT DOCUMENTS 2,974,727 A * 3/1961 Goodwin ..... E21B 43/11 166/55
3,430,711 A * 3/1969 Taggart ..... E21B 43/116 175/4.52
5,396,954 A 3/1995 Brooks
5,909,774 A 6/1999 Griffith et al.
6,378,627 B1 4/2002 Tubel et al.
6,513,599 B1 2/2003 Bixenman et al.
6,575,251 B2 6/2003 Watson et al.
6,581,689 B2 6/2003 Hailey, Jr.
6,601,646 B2 8/2003 Streich et al.
6,644,404 B2 11/2003 Schultz et al.
6,666,274 B2 12/2003 Hughes
6,695,067 B2 2/2004 Johnson et al.
6,749,023 B2 6/2004 Nguyen et al.
6,752,206 B2 6/2004 Watson et al.
6,789,623 B2 9/2004 Hill, Jr. et al.
6,817,410 B2 11/2004 Wetzel et al.
6,830,104 B2 12/2004 Nguyen et al.
6,843,317 B2 1/2005 Mackenzie
6,883,608 B2 4/2005 Parlar et al.
6,935,432 B2 8/2005 Nguyen
6,983,796 B2 1/2006 Bayne et al.
6,986,390 B2 1/2006 Doane et al.
6,997,263 B2 2/2006 Campbell et al.
7,044,231 B2 5/2006 Doane et al.
7,051,805 B2 5/2006 Doane et al.
7,055,598 B2 6/2006 Ross et al.
7,096,945 B2 8/2006 Richards et al.
7,100,691 B2 9/2006 Nguyen et al.
7,104,324 B2 9/2006 Wetzel et al.
7,111,685 B2 * 9/2006 Fields ..... E21B 49/06 166/298
7,243,732 B2 7/2007 Richard
7,252,142 B2 8/2007 Brezinski et al.
7,264,061 B2 9/2007 Dybevik et al.
7,343,983 B2 3/2008 Livingstone
7,363,967 B2 4/2008 Burris, II et al.
7,367,395 B2 5/2008 Vidrine et al.
7,385,523 B2 6/2008 Thomeer et al.
7,392,852 B2 7/2008 Richard
7,407,007 B2 8/2008 Tibbles
7,431,085 B2 10/2008 Coronado et al.
7,431,098 B2 10/2008 Ohmer et al.
7,441,605 B2 10/2008 Coronado et al.
7,562,709 B2 7/2009 Saebi et al.
7,584,799 B2 9/2009 Coronado et al.
7,591,321 B2 9/2009 Whitsitt et al.
7,703,507 B2 4/2010 Strickland
7,735,559 B2 6/2010 Malone
7,814,970 B2 10/2010 Strickland
8,037,934 B2 10/2011 Strickland
8,162,051 B2 4/2012 Strickland
8,272,439 B2 7/2012 Strickland
2004/0007829 A1 1/2004 Ross
2005/0039917 A1 2/2005 Hailey, Jr.
2005/0263287 A1 12/2005 Achee, Jr. et al.
2007/0056750 A1 3/2007 John et al.
2008/0125335 A1 5/2008 Bhaysar
2008/0142222 A1 6/2008 Howard et al.
2008/0257546 A1 10/2008 Cresswell et al.
2008/0314589 A1 12/2008 Guignard et al.
2009/0084556 A1 4/2009 Richards et al.
2009/0159279 A1 6/2009 Assal
2009/0159298 A1 6/2009 Assal
2009/0283279 A1 11/2009 Patel et al.
2009/0301720 A1 * 12/2009 Edwards ..... E21B 33/146 166/281
2010/0078171 A1 * 4/2010 Moody ..... E21B 33/138 166/285
2010/0155064 A1 6/2010 Nutley et al.
2011/0017453 A1 * 1/2011 Mytopher ..... E21B 43/117 166/298
2011/0035152 A1 2/2011 Durocher et al.
2012/0198988 A1 8/2012 Volberg et al.
2019/0153826 A1 * 5/2019 Tolman ..... E21B 43/116
2019/0153828 A1 * 5/2019 Tolman ..... E21B 43/116

* cited by examiner

PERFORATION DEVICES INCLUDING GAS SUPPLY STRUCTURES AND METHODS OF UTILIZING THE SAME

CROSS REFERENCE TO RELATED APPLICATION

This application claims the benefit of U.S. Provisional Application Ser. No. 62/608,219, filed Dec. 20, 2017, and is also related to and claims benefit of U.S. Provisional Application Ser. No. 62/589,800, filed Nov. 22, 2017, the disclosures of which are incorporated herein by reference in their entireties.

FIELD OF THE DISCLOSURE

The present disclosure relates generally to perforation devices for downhole tubing and more particularly to perforation devices that utilize a gas supply structure to provide a gas stream to a barrel of the perforation device.

BACKGROUND OF THE DISCLOSURE

Perforation devices may be utilized to form one or more perforations within downhole tubing extending within a wellbore that extends within a subterranean formation. Such perforations may permit and/or facilitate fluid communication between the subterranean formation and a downhole conduit that is defined by the downhole tubing. One way in which perforations historically have been formed is by utilizing shape charge perforation devices. Such shape charge perforation devices include a plurality of shape charges, which must be spaced-apart along a length of the shape charge perforation device. As such, increasing a number of shape charges in the shape charge perforation device requires that the length of the shape charge perforation device be increased.

In certain applications, it may be desirable to form a greater number of perforations than readily may be accommodated by the shape charge perforation device. As an example, a length of the shape charge perforation device required to permit the shape charge perforation device to include a desired number of shaped charges may be prohibitively long. As a more specific example, and when forming perforations in wellbores that include horizontal regions, the length of the shape charge perforation device may preclude motion of the shape charge perforation device through and/or past a heel of the wellbore, thereby precluding formation of perforations within the horizontal region of the wellbore. Thus, there exists a need for improved perforation devices and methods of utilizing the improved perforation devices.

SUMMARY OF THE DISCLOSURE

Perforation devices including gas supply structures and methods of utilizing the same. The perforation devices are configured to be positioned within a downhole conduit of downhole tubing and to form a plurality of perforations in the downhole tubing. The perforation devices include a magazine, a barrel, an action, and the gas supply structure.

The magazine is configured to contain a plurality of cartridges. The barrel extends between a breech and a muzzle. The breech is configured to receive a selected cartridge of the plurality of cartridges. The selected cartridge includes a selected projectile. The muzzle is configured, upon firing of the selected cartridge, to permit the selected projectile to exit the barrel at a muzzle velocity and with a muzzle trajectory. The action is configured to transfer the selected cartridge from the magazine to the breech of the barrel and to fire the selected cartridge.

The gas supply structure is configured to provide a gas stream to the barrel and includes a surface gas source and a gas supply conduit extending between the surface gas source and the barrel. The surface gas source is positioned within a surface region. The gas supply conduit is configured to convey the gas stream from the surface gas source to the barrel.

The methods include methods of perforating downhole tubing that extends within a wellbore that extends within a subterranean formation. The methods include positioning a perforation device within a downhole conduit that is defined by the downhole tubing. The methods also include providing a gas stream to a barrel of the perforation device with a gas supply structure that includes a surface gas source. The providing the gas stream includes conveying the gas stream from the surface gas source to the barrel via a gas supply conduit. The methods further include sequentially transferring a selected cartridge of a plurality of cartridges from a magazine of the perforation device to a breech of a barrel of the perforation device, firing the selected cartridge to accelerate a selected projectile of the selected cartridge from a muzzle of the barrel at a muzzle velocity and with a muzzle trajectory, and penetrating the downhole tubing with the selected projectile to form a perforation in the downhole tubing.

DETAILED DESCRIPTION AND BEST MODE OF THE DISCLOSURE

Figure 1:
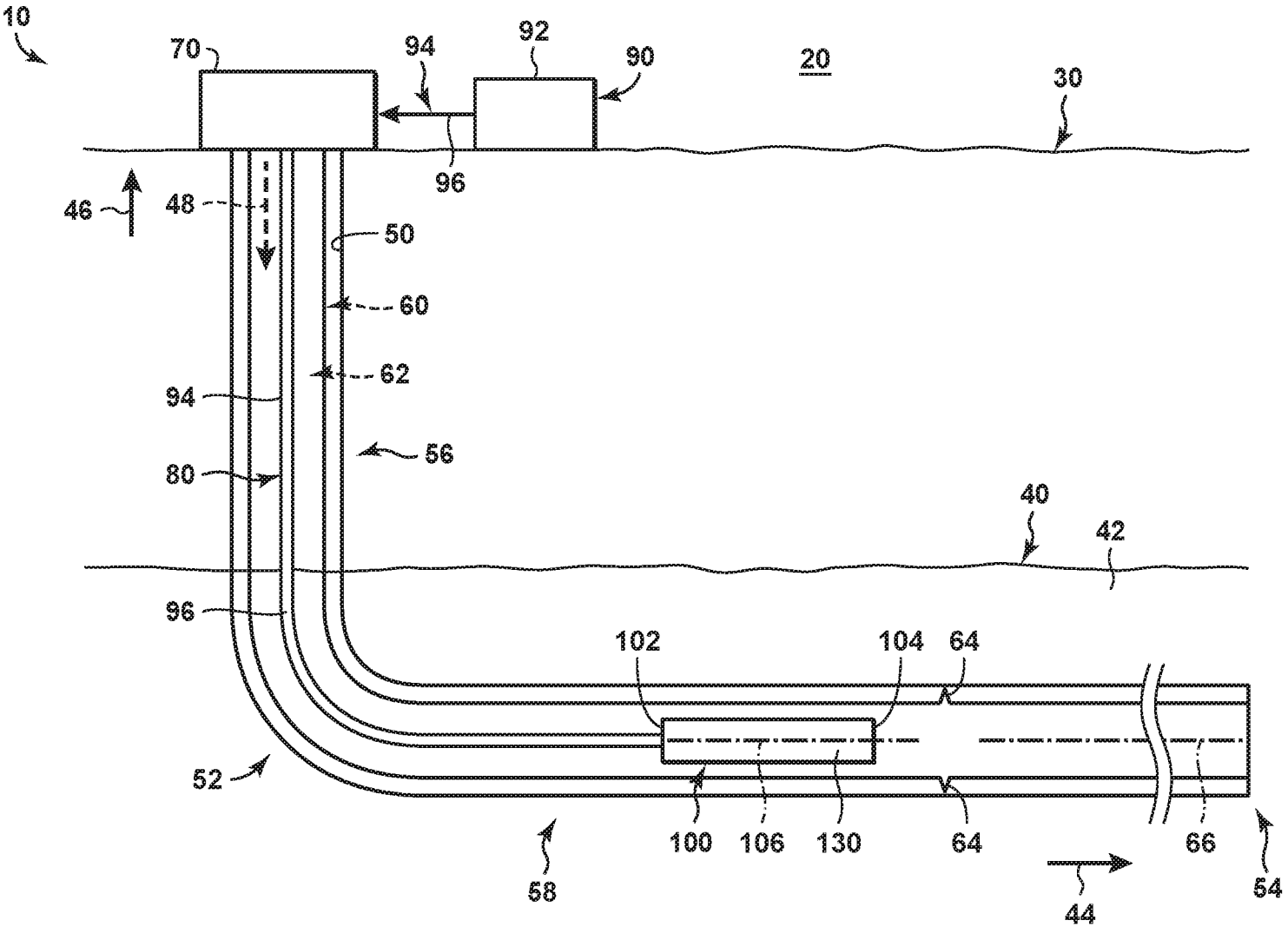
FIG. 1 is a schematic cross-sectional view of a hydrocarbon well that may include and/or utilize perforation devices and/or methods, according to the present disclosure, to form one or more perforations in the downhole tubing of the hydrocarbon well.

FIGS. 1-10 provide examples of perforation devices 100, of hydrocarbon wells 10 that may include and/or utilize perforation devices 100, and/or of methods 200 of perforating downhole tubing, according to the present disclosure. Elements that serve a similar, or at least substantially similar, purpose are labeled with like numbers in each of FIGS. 1-10, and these elements may not be discussed in detail herein with reference to each of FIGS. 1-10. Similarly, all elements may not be labeled in each of FIGS. 1-10, but reference numerals associated therewith may be utilized herein for consistency. Elements, components, and/or features that are discussed herein with reference to one or more of FIGS. 1-10 may be included in and/or utilized with any of FIGS. 1-10 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic cross-sectional view of a hydrocarbon well 10 that may include and/or utilize perforation devices 100 and/or methods 200, according to the present disclosure, to form one or more perforations 64 within downhole tubing 60. Downhole tubing 60 extends within a wellbore 50 that extends within a subterranean formation 40 and defines a downhole conduit 62. Downhole tubing 60 additionally or alternatively may be referred to herein as extending between a surface region 20 and the subterranean formation and/or as extending within a subsurface region 30. Subterranean formation 40 may include hydrocarbons 42.

As illustrated in FIG. 1, wellbore 50 may include a vertical, or an at least substantially vertical, region 56 and a horizontal, or deviated, region 58. Vertical region 56 may extend between surface region 20 and a heel 52 of the wellbore, and horizontal region 58 may extend between the heel and a toe 54 of the wellbore.

Perforation device 100 may be positioned within downhole conduit 62. This may include positioning the perforation device within vertical region 56 and/or within horizontal region 58 and may include flowing the perforation device from surface region 20 and/or from a wellhead 70 into the downhole conduit, such as in a conveyance fluid 48. When perforation device 100 is positioned within horizontal region 58, the perforation device may be conveyed through heel 52 to reach the horizontal region.

Perforation device 100 also includes and/or is in fluid communication with a gas supply structure 90 that is configured to provide a gas stream 96 to perforation device 100 and/or to a barrel 130 of the perforation device. Gas supply structure 90 includes a surface gas source 92 that is positioned within surface region 20. In some embodiments, the gas supply structure may be provided downhole in proximity to the perforation device, such that the device may be conveyed via wireline or slickline. Gas supply structure 90 also includes a gas supply conduit 94 that extends between the surface gas source and perforation device 100 and/or barrel 130 thereof. Gas supply conduit 94 is configured to convey gas stream 96 from the surface gas source to the perforation device and/or to the barrel.

As illustrated in dashed lines, gas supply structure 90 also may include a check valve 146 and/or a regulator 147. Check valve 146, when present, may be configured to permit fluid flow from surface gas source 92 to and/or toward barrel 130 but to prevent and/or restrict fluid flow from barrel 130 to and/or toward surface gas source 92 (e.g., backflow). Check valve 146 may be positioned in any suitable operative position, such as on gas supply conduit 94, at and/or near barrel 130.

Regulator 147 may be configured to selectively regulate a pressure and/or a flow rate of gas stream 96 that is provided to barrel 130. Additionally or alternatively, regulator 147 may be configured to selectively initiate and/or cease flow of gas stream 96, such as during periods of time during which perforation device 100 is not being utilized. Regulator 147, when present, may be positioned within any suitable portion of gas supply structure 90. As an example, regulator 147 may be positioned within and/or proximal surface gas source 92. As another example, regulator 147 may form a portion of and/or may be directly attached to perforation device 100. Examples of regulator 147 be or include any suitable pressure regulator, differential pressure regulator, diaphragm pressure regulator, valve, flow regulator, and/or other fluid flow control device.

Gas supply conduit 94 may be at least partially, and optionally completely, defined by an umbilical 80 that may extend between wellhead 70 and perforation device 100. Umbilical 80 may be utilized to position the perforation device within the downhole conduit and/or may be utilized to resist motion of the perforation device in a downhole direction 44.

Perforation device 100 may include an uphole end 102 and a downhole end 104. Perforation device 100 may define an elongate perforation device axis 106, which may extend between the uphole end and the downhole end. Uphole end 102 may face in an uphole direction 46, while downhole end 104 may face in downhole direction 44. Elongate perforation device axis 106 may extend along, may extend parallel to, and/or may extend at least substantially parallel to a tubing axis 66 of downhole tubing 60.

Perforation device 100 of FIG. 1 may include a plurality of additional structures, which are illustrated in FIGS. 2-8 and discussed in more detail herein with reference thereto. Stated another way, perforation device 100 of FIG. 1 may include and/or be any of the perforation devices that are illustrated in any of FIGS. 2-8 and discussed herein with reference thereto.

Figure 2:
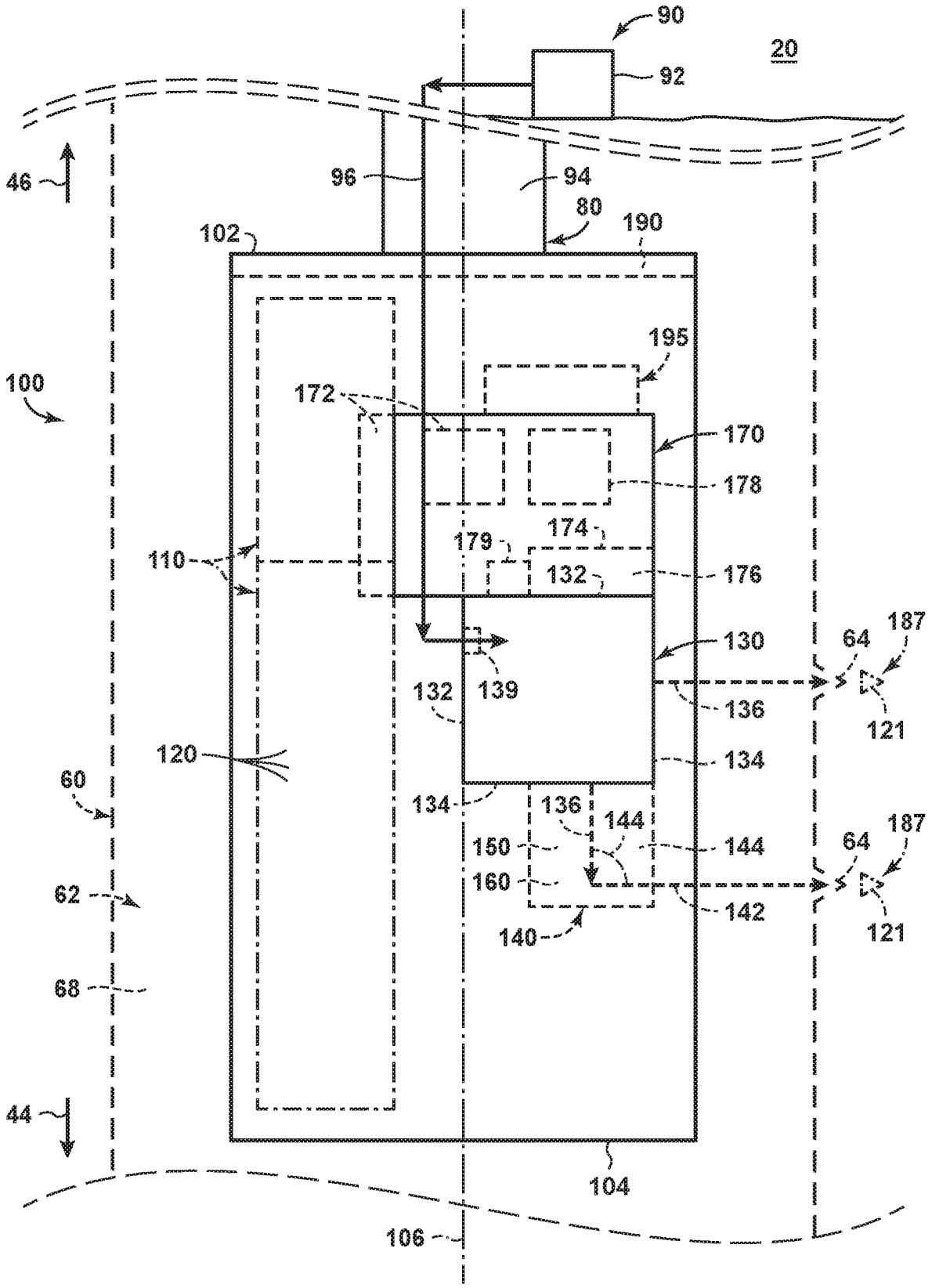
FIG. 2 is a schematic illustration of examples of perforation devices according to the present disclosure.

FIG. 2 is a schematic illustration of examples of perforation devices 100 according to the present disclosure, while FIGS. 3-8 are less schematic illustrations of examples of perforation devices 100 according to the present disclosure. FIGS. 3-8 may be more detailed and/or less schematic illustrations of perforation devices 100 that are illustrated in FIGS. 1-2. As such, any of the structures, functions, and/or features that are discussed herein with reference to perforation devices 100 of any one of FIGS. 1-8 may be included in and/or utilized with perforation devices 100 of any other of FIGS. 1-8 without departing from the scope of the present disclosure.

As illustrated in FIGS. 2-8, perforation devices 100 include a magazine 110 that is configured to house, contain, retain, and/or hold a plurality of cartridges 120. Perforation devices 100 also include barrel 130, which extends between a breech 132 and a muzzle 134. Perforation devices 100 further include a gas supply structure 90, which includes a surface gas source 92 and a gas supply conduit 94. Gas supply structure 90 is configured to provide a gas stream 96 to barrel 130. Perforation devices 100 also include an action 170. Components of perforation devices 100, including at least magazine 110, barrel 130, and action 170 may be operatively attached and/or coupled to one another and/or may be configured to move together and/or as a unit within a downhole conduit 62 that is defined by downhole tubing 60.

Figure 10:
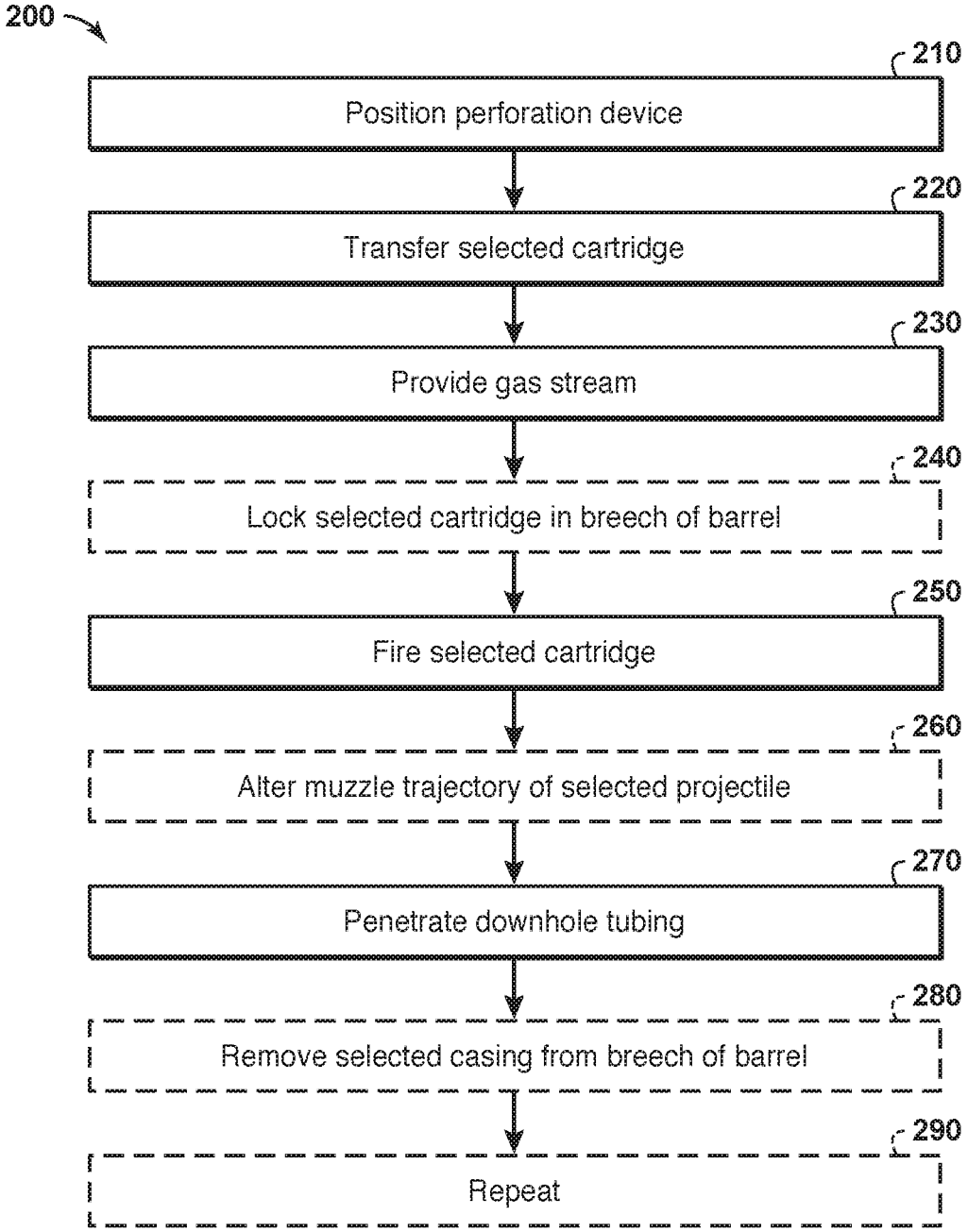
FIG. 10 is a flowchart depicting methods, according to the present disclosure, of perforating downhole tubing.

During operation of perforation devices 100, and as discussed in more detail herein with reference to methods 200 of FIG. 10, the perforation device may be positioned within downhole conduit 62. In addition, action 170 may be utilized to selectively and sequentially transfer a selected cartridge 120 from magazine 110 to breech 132 of barrel 130, and breech 132 may be configured to receive the selected cartridge from the magazine via the action. This is illustrated in dash-dot lines in FIGS. 3-8. As illustrated therein, action 170 may remove selected cartridge 120 from magazine 110, as indicated at 183, and may position the selected cartridge within breech 132 of barrel 130, as indicated at 184.

In addition, gas supply structure 90 may provide gas stream 96 to barrel 130. When perforation device 100 is positioned within downhole conduit 62, supply of gas stream 96 to barrel 130 may restrict and/or block flow of a wellbore fluid 68, which may extend within downhole conduit 62, into barrel 130. Stated another way, supply of the gas stream to the barrel may maintain a gaseous environment within barrel 130 and/or between breech 132 and muzzle 134 of the barrel. Such a configuration may increase the muzzle velocity of projectiles fired from barrel 130 relative to a muzzle velocity that would be obtainable if a liquid wellbore fluid was allowed to flow into the barrel from the downhole conduit.

Figure 4:
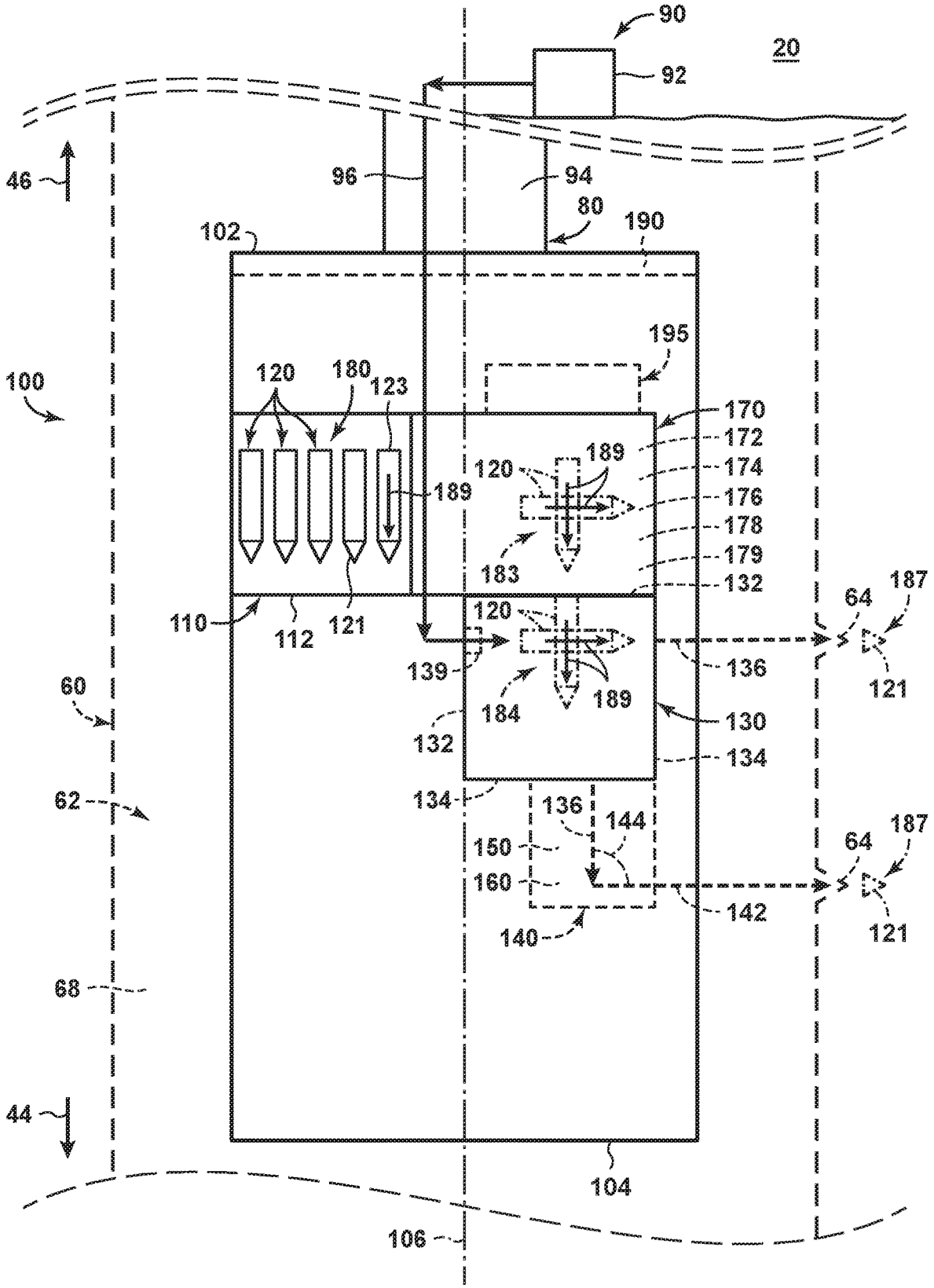
FIG. 4 is a less schematic illustration of examples of perforation devices according to the present disclosure.
Figure 5:
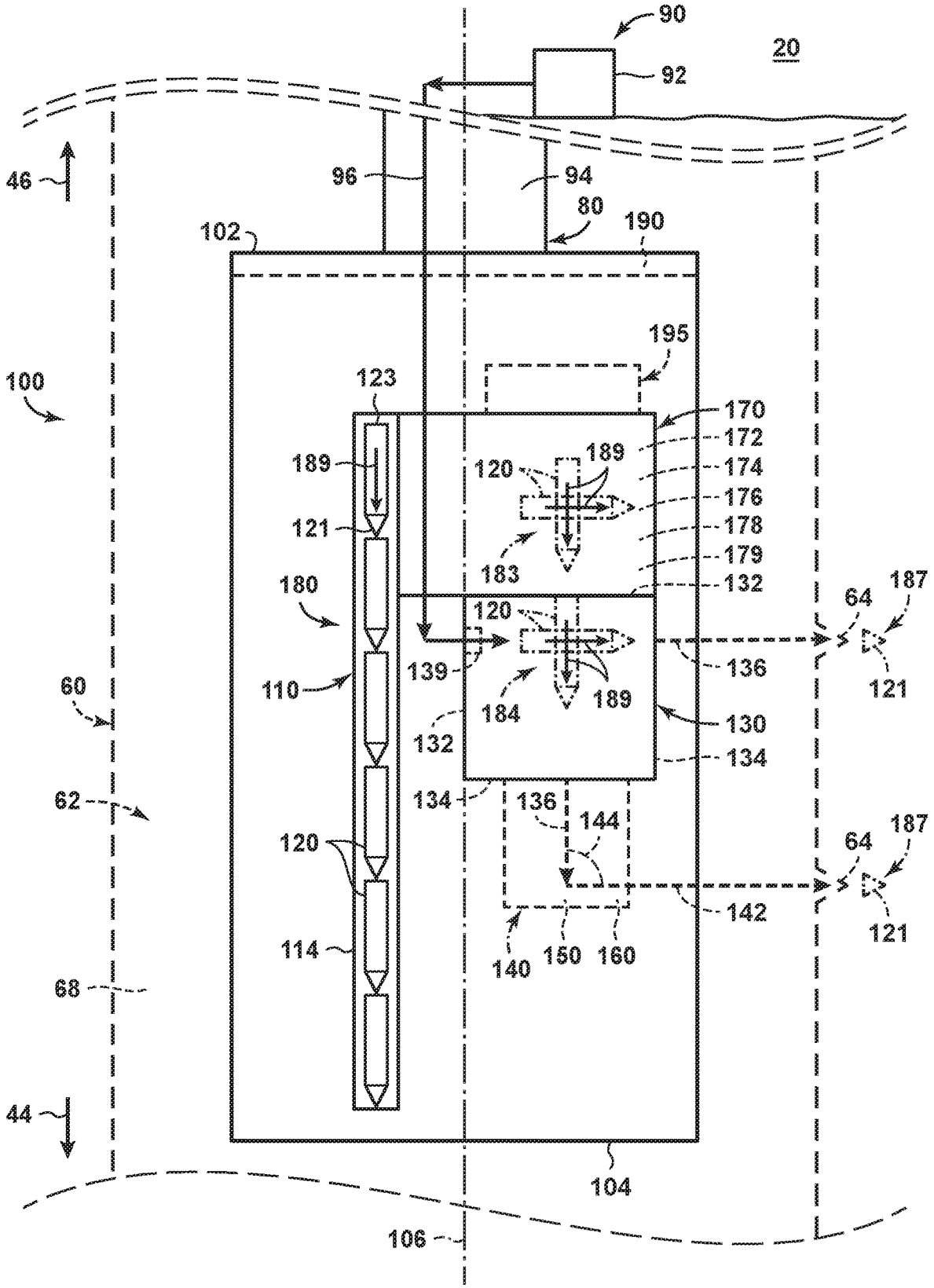
FIG. 5 is a less schematic illustration of examples of perforation devices according to the present disclosure.
Figure 6:
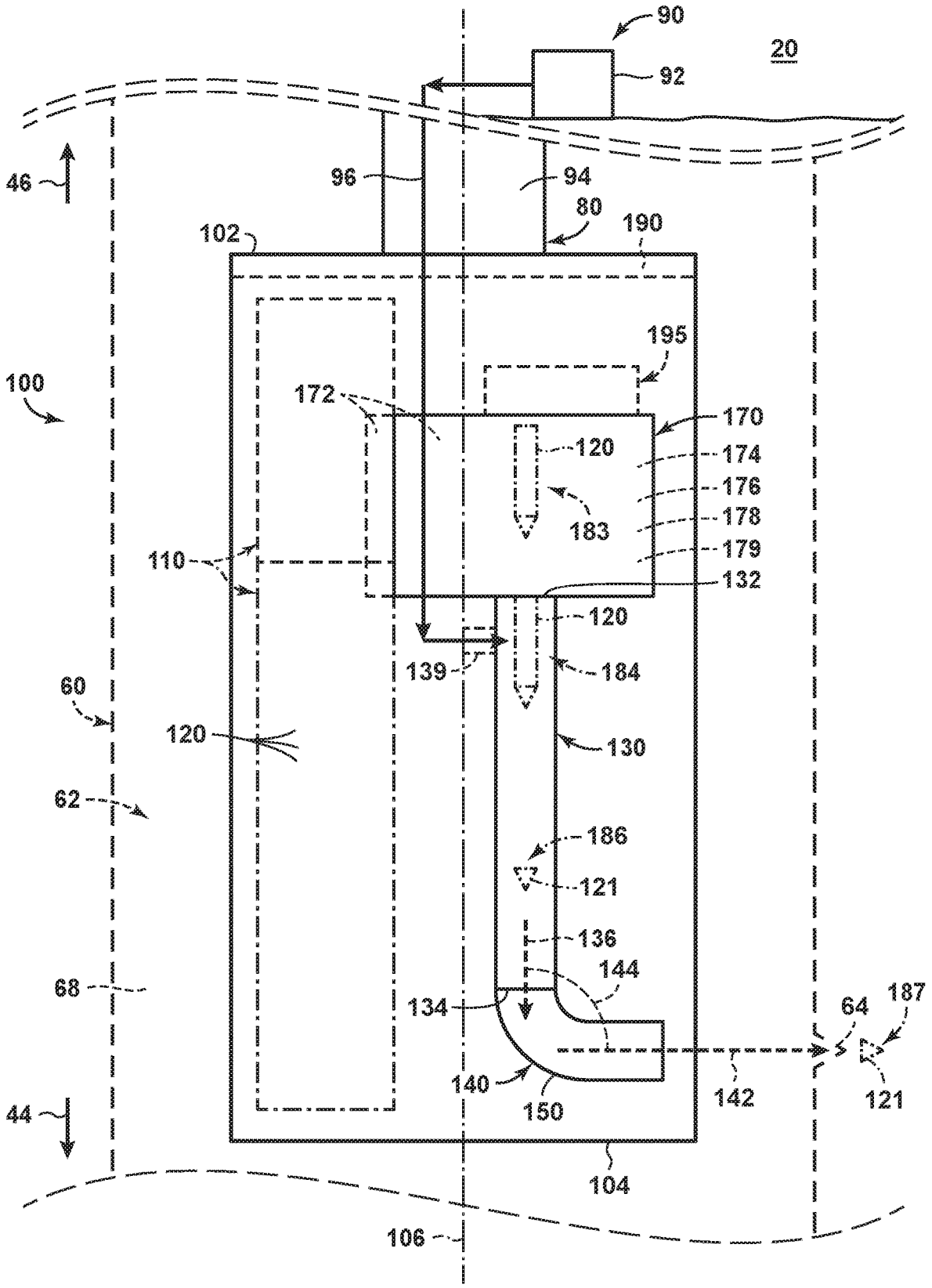
FIG. 6 is a less schematic illustration of examples of perforation devices according to the present disclosure.
Figure 7:
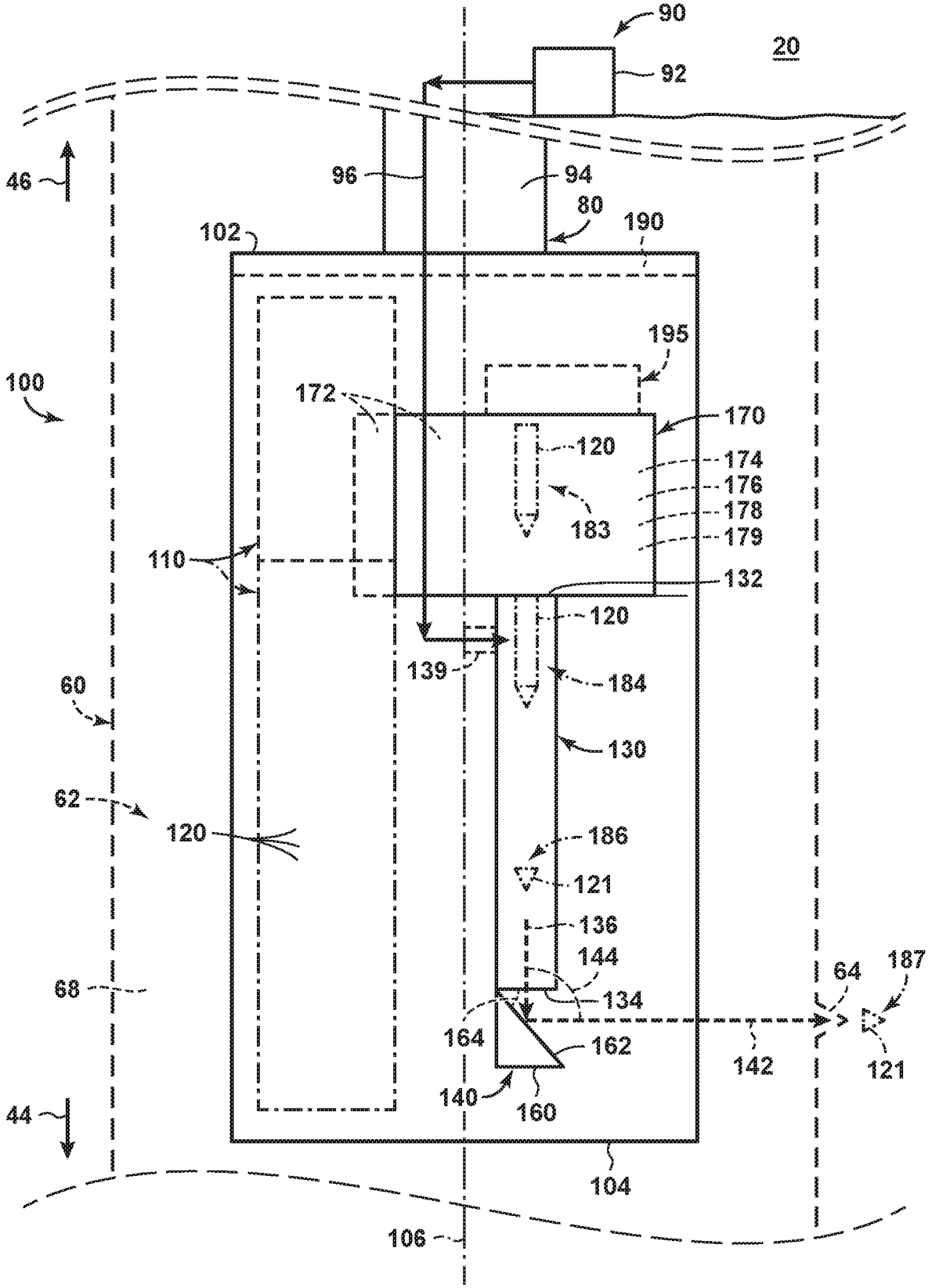
FIG. 7 is a less schematic illustration of examples of perforation devices according to the present disclosure.
Figure 8:
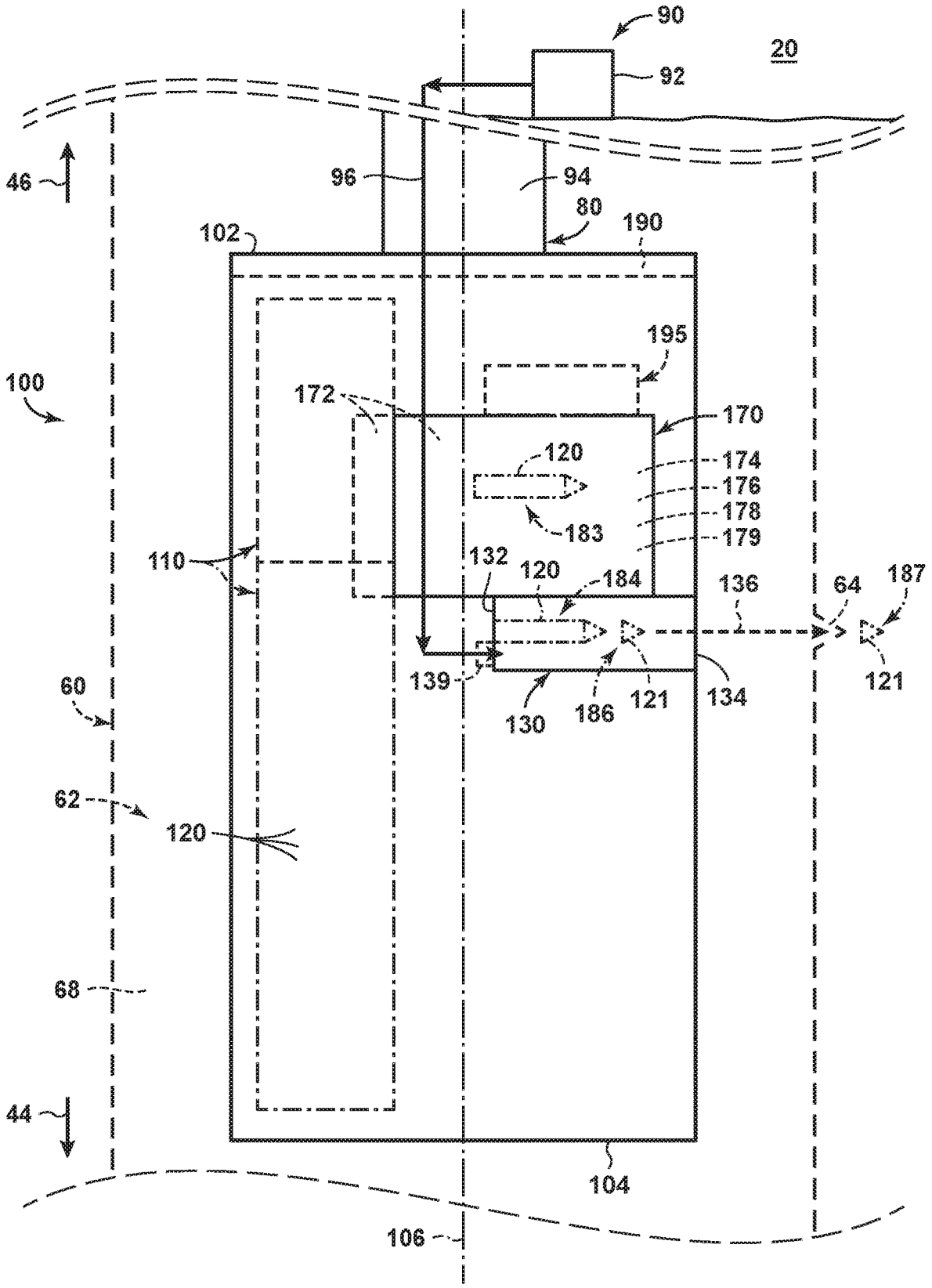
FIG. 8 is a less schematic illustration of examples of perforation devices according to the present disclosure.

Subsequent to receipt of the selected cartridge within the breech of the barrel, action 170 may fire the selected cartridge. Firing the selected cartridge may accelerate a selected projectile 121 of the selected cartridge through barrel 130, as illustrated in FIGS. 6-8 at 186. The selected projectile may exit muzzle 134 of barrel 130 at a muzzle velocity and with a muzzle trajectory 136. The selected projectile then may penetrate downhole tubing 60, thereby forming a perforation 64 within the downhole tubing before coming to rest within the subterranean formation, as illustrated in FIGS. 3-8 at 187. This process may be repeated any suitable number of times to form and/or define any suitable number of perforations 64 within downhole tubing 60.

It is within the scope of the present disclosure that gas supply structure 90 may provide gas stream 96 to barrel 130 in any suitable manner. As an example, the gas supply structure may provide the gas stream to the breech of the barrel. As another example, the barrel may include a gas injection port 139, and the gas supply structure may provide the gas stream to the gas injection port. A gaseous media may be desired within the barrel to provide a low viscosity media for enhanced acceleration of the projectile through the barrel, versus a liquid filled barrel.

In some embodiments, surface gas source 92 may include and/or be any suitable gas source that is positioned within surface region 20. Such a surface gas source may provide the gas stream to the barrel via gas supply conduit 94 that may be defined by umbilical 80. Examples of the gas supply conduit includes coiled tubing and jointed tubing or pipe, such as drill pipe.

Gas stream 96 may include and/or be any suitable gas stream that may be provided to barrel 130. As examples, gas stream 96 may include one or more of a nitrogen gas stream, a carbon dioxide gas stream, an inert gas stream, a gaseous hydrocarbon stream, and/or an air stream. In other embodiments, the gas source may be conveyed from the surface and generated at a downhole location, including but not limited to, in proximity to or directly within the barrel, such as via a chemical reaction, including in some embodiments, a burning or reaction product, such as by an explosive or cartridge charge.

FIGS. 2-5 illustrate two different orientations for muzzle trajectory 136, one that is directed at least substantially toward downhole tubing 60 and one that is directed at least substantially along elongate perforation device axis 106 and/or at least substantially in downhole direction 44. Perforation devices 100, according to the present disclosure, may include barrels 130 that may be oriented to produce either, or both, of these muzzle trajectories.

In addition to the more schematic examples of FIGS. 2-5, a less schematic example of a barrel 130 that is oriented to produce a muzzle trajectory 136 that is directed at least substantially toward downhole tubing 60 is illustrated in FIG. 8. In this example, barrel 130 may include and/or be a straight barrel. In addition, muzzle 134 faces toward downhole tubing 60 such that, upon exiting the barrel, projectile 121 contacts and/or penetrates downhole tubing 60. Stated another way, barrel 130 is oriented, within perforation device 100, such that the barrel extends at a skew angle, or even perpendicular, to elongate perforation device axis 106. Under these conditions, muzzle trajectory 136 may define an angle of incidence with downhole tubing 60, and the selected projectile may penetrate the downhole tubing and generate perforation 64 within the downhole tubing. The selected projectile then may enter the subterranean formation, as indicated in dash-dot lines in FIGS. 2-8 at 187.

The angle of incidence may be measured between the muzzle trajectory and a direction that is normal to an inner surface of the downhole tubing at a point where the modified trajectory intersects the inner surface of the downhole tubing. Examples of the angle of incidence includes angles of less than a ricochet angle, or less than a threshold ricochet angle, between the selected projectile and the downhole tubing. As used herein, the phrase "ricochet angle" may refer to an angle that is measured relative to a surface normal direction of a surface. When a projectile contacts the surface at an angle of incidence that is less than the ricochet angle, the projectile will penetrate the surface and/or will not ricochet from the surface. In contrast, when the projectile contacts the surface at an angle of incidence that is greater than the ricochet angle, the projectile will bounce off, or ricochet from, the surface. Additional examples of the angle of incidence include angles of at most 45 degrees, at most 40 degrees, at most 35 degrees, at most 30 degrees, at most 25 degrees, at most 20 degrees, at most 15 degrees, at most 10 degrees, at most 5 degrees, at most 2.5 degrees, at most 1 degree, and/or at least substantially zero degrees. The angle of incidence may be at least substantially equal to zero degrees in the illustration of FIGS. 2-5 and 8.

In addition to the more schematic examples of FIGS. 2-5, less schematic examples of barrels 130 that are oriented to produce a muzzle trajectory 136 that is directed at least substantially along elongate perforation device axis 106 and/or at least substantially in downhole direction 44 are illustrated in FIGS. 6-7. In these examples, perforation device 100 includes a trajectory-altering structure 140. Trajectory-altering structure 140, when present, is configured to receive the selected projectile from muzzle 134 of barrel 130 and to act upon the selected projectile such that, upon exiting the trajectory-altering structure, the selected projectile defines a modified trajectory 142 that differs from muzzle trajectory 136. Stated another way, trajectory-altering structure 140 may be configured to alter the trajectory of the selected projectile from muzzle trajectory 136 to modified trajectory 142. In these examples, the modified trajectory may direct the selected projectile toward and/or into contact with downhole tubing 60, thereby causing the selected projectile to penetrate the downhole tubing and generate perforation 64 within the downhole tubing. The selected projectile then may enter the subterranean formation, as indicated in dash-dot lines in FIGS. 2-8 at 187.

As discussed, perforation device 100 may include and/or be an elongate perforation device that has, or defines, elongate perforation device axis 106. In addition, and as illustrated in FIGS. 2-7, muzzle trajectory 136 may be in downhole direction 44 and/or may be oriented along, or at least substantially along, the elongate perforation device axis. Stated another way, and when perforation device 100 is positioned within downhole conduit 62, muzzle trajectory 136 may be oriented along an elongate axis of downhole tubing 60 (such as tubing axis 66 that is illustrated in FIG. 1) and/or may define less than a threshold orientation angle with the elongate axis of the downhole tubing. Examples of the threshold orientation angle include threshold orientation angles of less than 25 degrees, less than 20 degrees, less than 15 degrees, less than 10 degrees, less than 5 degrees, less than 2.5 degrees, and/or less than 1 degree.

As discussed, modified trajectory 142 differs from muzzle trajectory 136. As an example, modified trajectory 142 and muzzle trajectory 136 may define a modification angle 144 therebetween. Examples of the modification angle include modification angles of at least 45 degrees, at least 50 degrees, at least 55 degrees, at least 60 degrees, at least 65 degrees, at least 70 degrees, at least 75 degrees, at least 80 degrees, at least 85 degrees, at least 90 degrees, at most 135 degrees, at most 130 degrees, at most 125 degrees, at most 120 degrees, at most 115 degrees, at most 110 degrees, at most 105 degrees, at most 100 degrees, at most 95 degrees, and/or at most 90 degrees.

As also discussed, modified trajectory 142 directs selected projectile 121 into contact with downhole tubing 60. Stated another way, modified trajectory 142 and downhole tubing 60 may define an angle of incidence therebetween. The angle of incidence may be measured between the modified trajectory and a direction that is normal to an inner surface of the downhole tubing at a point where the modified trajectory intersects the inner surface of the downhole tubing. Examples of the angle of incidence are disclosed herein.

Trajectory-altering structure 140 may include and/or be any suitable structure that may be adapted, configured, and/or shaped to modify the trajectory of selected projectile 121 from muzzle trajectory 136 to modified trajectory 142. In addition, trajectory-altering structure 140 may be incorporated into perforation device 100 in any suitable manner. As an example, trajectory-altering structure 140 may be operatively attached to barrel 130, and this operative attachment may include direct or indirect attachment between the trajectory-altering structure and the barrel.

As another example, trajectory-altering structure 140 and barrel 130 may define a unitary structure. As a more specific example, trajectory-altering structure 140 and barrel 130 may be formed and/or defined from a continuous length of material. The continuous length of material may include both a straight, or linear, region that defines barrel 130 and a curved, or bent, region that defines trajectory-altering structure 140. Under these conditions, muzzle 134 may be defined as a location, within the continuous length of material, in which the continuous length of material transitions from the straight region to the curved region.

As yet another example, trajectory-altering structure 140 and barrel 130 may be spaced-apart from one another and/or may define a gap therebetween. Under these conditions, trajectory-altering structure 140 and barrel 130 both may be operatively attached to perforation device 100 and thus may be indirectly attached to one another via one or more other components of perforation device 100.

An example of trajectory-altering structure 140 includes a bent tubular 150, examples of which are illustrated schematically in FIGS. 2-5 and less schematically in FIG. 6. Bent tubular 150 may extend at least partially within muzzle trajectory 136, may extend from barrel 130, may be an extension of barrel 130, and/or may be a curved, nonlinear, and/or arcuate region of barrel 130. Stated another way, bent tubular 150 may be (directly or indirectly) operatively attached to barrel 130 and/or may be defined by a unitary structure that includes barrel 130. When the selected projectile enters bent tubular 150, the selected projectile may follow the curved and/or arcuate shape of the bent tubular, thereby transitioning from the muzzle trajectory to the modified trajectory.

Bent tubular 150 may define an average structure transverse cross-sectional area and barrel 130 may define an average barrel transverse cross-sectional area. To facilitate modification of the selected projectile's trajectory from muzzle trajectory 136 to modified trajectory 142, the average barrel transverse cross-sectional area may be less than a threshold fraction of the average structure transverse cross-sectional area. Examples of the threshold fraction include threshold fractions of 90%, 80%, 70%, 60%, 50%, 40%, 30%, 20%, and/or 10%.

It is within the scope of the present disclosure that bent tubular 150 may be formed and/or defined by any suitable material and/or materials. As examples, bent tubular 150 may be formed and/or defined by one or more of a non-galling material, a ceramic material, a ceramic clad material, a material that is distinct from a material that defines barrel 130, the material that defines barrel 130, and/or a corrosion-resistant material. Such materials may be stable and/or non-reactive within subterranean formation 40 and/or may facilitate modification of the trajectory of the selected projectile without, or with less than a threshold amount of, damage to the selected projectile and/or to the trajectory-altering structure.

Another example of trajectory-altering structure 140 includes a ricochet-inducing structure 160, examples of which are illustrated schematically in FIGS. 2-5 and less schematically in FIG. 7. As illustrated in FIG. 7, ricochet-inducing structure 160 may include a ricochet-inducing surface 162 that may be oriented at a ricochet-inducing surface angle 164 relative to muzzle trajectory 136. When the selected projectile contacts the ricochet-inducing surface, the selected projectile may ricochet from the ricochet-inducing surface, thereby transitioning from the muzzle trajectory to the modified trajectory. Examples of the ricochet-inducing surface angle include angles of at least 15 degrees, at least 20 degrees, at least 25 degrees, at least 30 degrees, at least 35 degrees, at least 40 degrees, at least 45 degrees, at most 75 degrees, at most 70 degrees, at most 65 degrees, at most 60 degrees, at most 55 degrees, at most 50 degrees, and/or at most 45 degrees.

Figure 3:
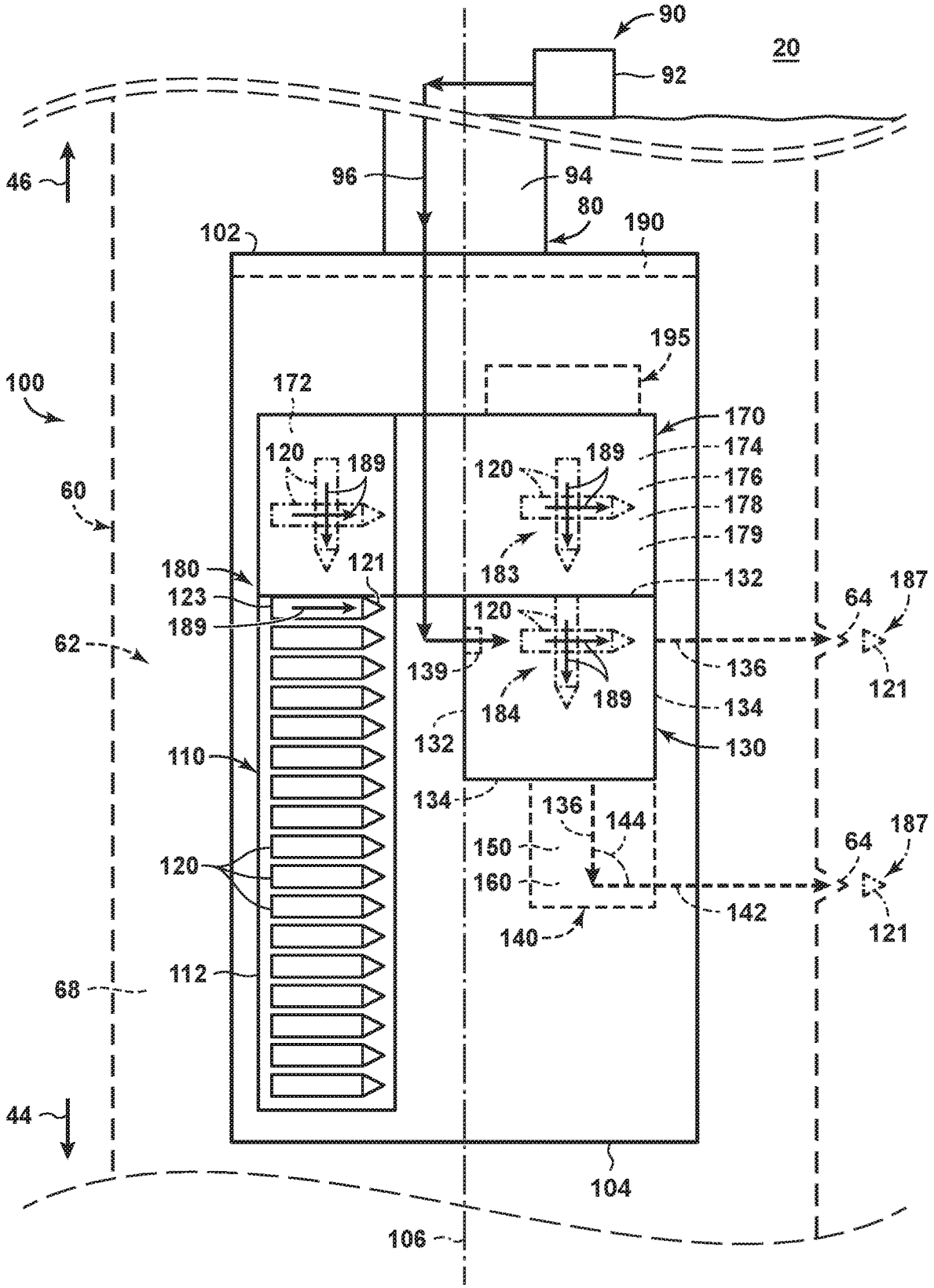
FIG. 3 is a less schematic illustration of examples of perforation devices according to the present disclosure.

Returning more generally to FIGS. 2-8, magazine 110 may include any suitable structure that maybe configured to store, house, and/or contain the plurality of cartridges 120. Examples of magazine 110 include a stack magazine 112, as illustrated in FIGS. 3-4, and/or a tubular magazine 114, as illustrated in FIG. 5. The examples of magazines 110 in FIGS. 3-5 and 8 are not exclusive and are not limited to the particular examples of perforation devices 100, or other components thereof, shown in these figures.

As illustrated schematically in dash-dot lines in FIGS. 2 and 6-8 and in solid lines in FIGS. 3 and 5, magazine 110 may extend at least partially, or even completely, along a length of barrel 130. Stated another way, magazine 110 may extend at least partially, or even completely, between breech 132 and muzzle 134 of barrel 130. Such a configuration may facilitate a decrease in an overall size and/or length of perforation device 100, as cartridges 120 may be stored at least partially within a portion of a length of the perforation device that also includes the barrel. Additionally or alternatively, and as illustrated in dashed lines in FIGS. 2 and 6-8 and in solid lines in FIG. 4, magazine 110 may extend away from both breech 132 and muzzle 134 of barrel 130 and/or may not extend along the length of barrel 130.

It is within the scope of the present disclosure that the plurality of cartridges 120 may include any suitable number of cartridges. As examples, the plurality of cartridges may include at least 50, at least 100, at least 200, at least 300, at least 400, at least 500, at most 1000, at most 800, and/or at most 600 cartridges. Inclusion of such a large number of cartridges 120 within magazine 110 may permit a corresponding number of perforations 64 to be formed within downhole tubing 60 without a need to remove perforation device 100 from downhole conduit 62 and/or without a need to reload magazine 110. It also is within the scope of the present disclosure that perforation device 100 may include a plurality of magazines 110. Under these conditions, each magazine 110 in the plurality of magazines 110 may include any suitable number of cartridges 120, examples of which are disclosed herein.

As illustrated in FIGS. 3-5, selected cartridge 120 may have and/or define a projectile direction 189, which may extend from a head 123 of the selected cartridge toward projectile 121 of the selected cartridge (e.g., the selected projectile). It is within the scope of the present disclosure that cartridges 120 may have any suitable projectile direction while contained within magazine 110 and/or prior to being transferred from the magazine to the breech of the barrel. It also is within the scope of the present disclosure that projectile direction 189 may vary in any suitable manner as the selected cartridge is transferred from the magazine to the breech of the barrel.

As an example, projectile direction 189 of the selected cartridge while the selected cartridge is within the magazine, which is indicated at 180, may be parallel, or at least substantially parallel, to the projectile direction of the selected cartridge while the selected cartridge is within the breech of the barrel, which is indicated at 184. Stated another way, the projectile direction of the selected cartridge, while the selected cartridge is contained within the magazine, may be parallel, or at least substantially parallel, to muzzle trajectory 136.

As another example, projectile direction 189 may be perpendicular, or at least substantially perpendicular, to muzzle trajectory 136 while the selected projectile is contained within magazine 110 and/or prior to the selected cartridge being transferred from the magazine to the breech of the barrel, as indicated at 180. Under these conditions, perforation device 100 may include a cartridge rotating structure 172. Cartridge rotating structure 172 may form a portion of magazine 110, may form a portion of action 170, and/or may be a distinct structure of perforation device 100. When present, cartridge rotating structure 172 may be configured to receive selected cartridge 120 and to rotate the selected cartridge such that projectile direction 189 is parallel, or at least substantially parallel, to muzzle trajectory 136. The selected projectile then may be transferred to breech 132 of barrel 130, as indicated at 184.

Barrel 130 may include any suitable structure that may define breech 132 and muzzle 134, that may extend between the breech and the muzzle, and/or that may be configured to permit the selected projectile to exit the muzzle at the muzzle velocity and/or with the muzzle trajectory. In addition, a single, or only one, barrel 130 may be configured to receive and to fire each cartridge 120 in the plurality of cartridges. Stated another way, barrel 130 may be configured to sequentially receive each cartridge in the plurality of cartridges, to fire each cartridge in the plurality of cartridges, and/or to permit each projectile of each cartridge in the plurality of cartridges to exit the barrel via muzzle 134.

Barrel 130 may have and/or define a barrel length, which may be measured between breech 132 and muzzle 134. The barrel length may be selected to provide a desired, or a target, muzzle velocity for the selected projectile upon exiting the muzzle of the barrel. Barrel 130 also may be a rifled barrel, which may increase muzzle velocity and/or penetration of projectiles 121 that may be fired therethrough.

Barrel 130 may be formed and/or defined from any suitable material and/or materials. As examples, barrel 130 may be formed from one or more of a corrosion-resistant material, steel, and stainless steel.

Figure 9:
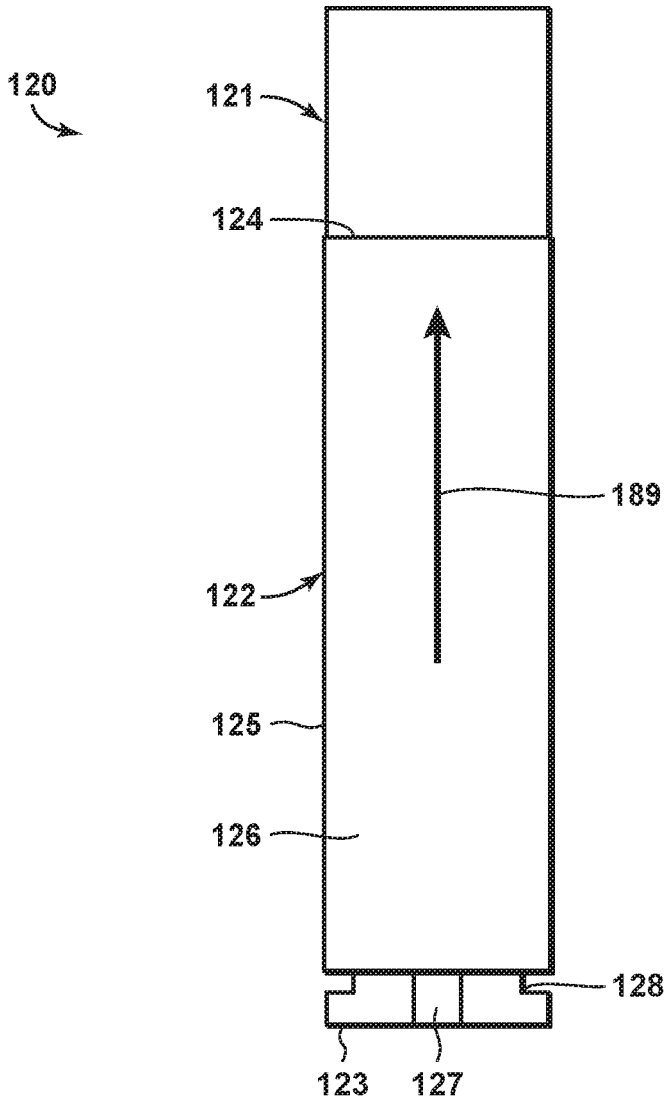
FIG. 9 is a schematic representation of a cartridge that may be included in and/or utilized with perforation devices and/or methods, according to the present disclosure.

As illustrated in FIG. 9 and discussed in more detail herein with reference thereto, cartridges 120 that may be utilized within and/or that may form a portion of perforation devices 100 may include a casing 122. Casing 122, when present, may remain within breech 132 of barrel 130 subsequent to firing of projectile 121. Under these conditions, action 170 may be configured to remove the casing from the breech of the barrel, such as to permit a subsequent cartridge to be positioned within the breech of the barrel, and perforation device 100 may include a casing collector 195. Casing collector 195, when present, may be configured to retain a plurality of casings, or spent casings, that remain after firing the plurality of projectiles. Stated another way, casing collector 195 may collect and/or retain casings 122, thereby retaining the casings within perforation device 100 and/or preventing the casings from accumulating within downhole conduit 62.

As illustrated in dashed lines in FIGS. 2-8, perforation devices 100 also may include a rotation structure 190. Rotation structure 190, when present, may be configured to selectively rotate at least a portion of perforation device 100, such as barrel 130 and/or trajectory-altering structure 140, within downhole conduit 62. This selective rotation may permit and/or facilitate formation of a plurality of perforations within downhole tubing 60 that has and/or defines a desired angular perforation distribution. Stated another way, rotation structure 190 may be utilized to rotate at least the portion of perforation device 100, such as about elongate perforation device axis 106, thereby permitting formation of perforations 64 within downhole tubing 60 at a variety of different, or desired, angular orientations with respect to the elongate perforation device axis. Stated yet another way, rotation structure 190 may be configured to selectively vary a relative orientation between downhole tubing 60 and muzzle trajectory 136 and/or modified trajectory 142.

It is within the scope of the present disclosure that perforation device 100 may have and/or define any suitable length, which may be measured along elongate perforation device axis 106, and/or maximum transverse cross-sectional dimension, which may be measured perpendicular to the elongate perforation device axis. Examples of the length of perforation device 100 include lengths of at least 25 centimeters, at least 50 centimeters, at least 75 centimeters, at least 100 centimeters, at least 150 centimeters, at least 200 centimeters, at least 250 centimeters, at least 300 centimeters, at least 400 centimeters, at least 500 centimeters, at most 1000 centimeters, at most 750 centimeters, at most 500 centimeters, and/or at most 250 centimeters. Examples of the maximum transverse cross-sectional extent include extents of less than 20 centimeters, less than 18 centimeters, less than 16 centimeters, less than 14 centimeters, less than 12 centimeters, less than 10 centimeters, less than 8 centimeters, less than 6 centimeters, and/or less than 4 centimeters.

Action 170 may include any suitable structure that may be adapted, configured, designed, and/or constructed to transfer cartridges 120 from magazine 110 to breech 132 of barrel 130 and/or to fire cartridges 120. As an example, action 170 may include one or more conventional structures of conventional firearm actions. As a more specific example, action 170 may include a bolt 174. Bolt 174, when present, may be configured to selectively and sequentially urge cartridges 120, or the selected cartridge 120, from magazine 110 and toward and/or into breech 132 of barrel 130.

As another more specific example, action 170 and/or bolt 174 thereof may include a lock mechanism 176. Lock mechanism 176, when present, may be configured to selectively and sequentially lock cartridges 120, or the selected cartridge 120, within breech 132. Lock mechanism 176 also may be referred to herein as a securing mechanism and/or as a retention mechanism that may be configured to secure and/or retain cartridges 120 within breech 132.

As yet another more specific example, action 170 may include a firing mechanism 178. Firing mechanism 178, when present, may be configured to selectively and sequentially fire cartridges 120, or the selected cartridge 120, subsequent to cartridges 120 being positioned within breech 132 and/or locked within breech 132. Examples of firing mechanism 178 and/or of components thereof include a firing pin, a hammer, and/or a trigger assembly.

As another more specific example, action 170 may include an extractor 179. Extractor 179, when present, may be configured to selectively and sequentially extract cartridges 120, or casings 122 of cartridges 120, from breech 132. As an example, and as illustrated in FIG. 9 and discussed in more detail herein with reference thereto, cartridges 120 may include an extractor groove 128, and extractor 179 may be configured to operatively engage the extractor groove to extract cartridges 120 from breech 132.

As discussed, action 170 may be configured to selectively fire cartridges 120, and it is within the scope of the present disclosure that the action may fire the cartridges responsive to and/or based upon any suitable criteria. As an example, action 170 may be configured to fire cartridges 120, or to fire a given cartridge 120, responsive to receipt of a firing signal. Examples of the firing signal include an electronic firing signal, a mechanical firing signal, a wireless firing signal, a predetermined pressure pulse sequence within the wellbore fluid, and/or a predetermined mechanical force sequence applied to the perforation device by umbilical 80.

Cartridges 120 may include any suitable structure that may be contained within magazine 110, that may include projectiles 121, and/or that may be selectively fired by action 170. This may include conventional cartridges 120 that may be fired from conventional firearms (i.e., a firearm cartridge) and/or specialized cartridges 120 that may be specially designed and/or constructed to be utilized within perforation devices 100.

FIG. 9 is a schematic representation of a cartridge 120 that may be included in and/or utilized with perforation devices 100 and/or methods 200, according to the present disclosure. Cartridges 120 illustrated in the example of FIG. 9 include a casing 122 that defines a head 123, a mouth 124, and a body 125 that extends between the head and the mouth. Cartridges 120 also include a projectile 121, which may be positioned within mouth 124, a propellant 126, which may be contained within body 125 and/or within a volume that is at least partially defined by body 125, an igniter 127, and/or an extractor groove 128.

Igniter 127 may include any suitable structure and/or composition that may be utilized to ignite propellant 126. Examples of igniter 127 include any suitable primer, or conventional primer, electronic ignition structure, and/or chemical ignition structure.

Propellant 126 may include any suitable structure and/or composition that may be ignited by igniter 127 and/or that may accelerate projectile 121 subsequent to being ignited by igniter 127. Examples of propellant 126 include a charge of powder, a charge of gunpowder, and/or a charge of smokeless powder.

Casing 122 may include any suitable structure that may contain propellant 126 and/or that may operatively interconnect, may be operatively attached to, and/or may include projectile 121 and igniter 127. Examples of casing 122 include a metallic casing, a brass casing, a steel casing, a biodegradable casing, and/or a casing that is configured to corrode within the wellbore and/or within the wellbore fluid.

Projectile 121 may include any suitable structure that may be accelerated from barrel 130, such as via ignition of propellant 126. This may include any suitable conventional projectile that may be configured to be utilized in a conventional firearm and/or any suitable specialized projectile that may be specially configured to be utilized within perforation devices 100. Examples of projectile 121 include a metallic projectile, an armor-piercing projectile, an explosive projectile, a bi-metallic projectile, a tank-penetrating projectile, and/or a sabot-encased projectile.

FIG. 10 is a flowchart depicting methods 200, according to the present disclosure, of perforating downhole tubing with a perforation device 100. The downhole tubing may define a downhole conduit and may extend within a wellbore that extends within a subterranean formation. Methods 200 include positioning the perforation device at 210 and transferring a selected cartridge from a magazine to a breech of a barrel at 220. Methods 200 also include providing a gas stream to the barrel at 230 and may include locking the selected cartridge within the breech of the barrel at 240. Methods 200 further include firing the selected cartridge at 250 and may include altering a muzzle trajectory of a selected projectile at 260. Methods 200 also include penetrating downhole tubing with the selected projectile at 270, and may include removing a selected casing from the breech of the barrel at 280 and/or repeating at least a portion of the methods at 290.

Positioning the perforation device at 210 may include positioning the perforation device within the downhole conduit. This may include flowing the perforation device from a surface region and/or in a downhole direction within the downhole conduit. The flowing may include flowing the magazine and the barrel of the perforation device as a unit, or as an assembly, within the downhole conduit. Stated another way, at least the magazine and the barrel may be operatively linked to one another and/or may be configured to move as a unit, or as an assembly, within the downhole conduit.

Examples of the perforation device are disclosed herein with reference to perforation device 100 of FIGS. 2-8. Examples of the barrel are disclosed herein with reference to barrel 130 of FIGS. 2-8. Examples of the magazine are disclosed herein with reference to magazine 110 of FIGS. 2-8.

Transferring the selected cartridge from the magazine to the breech of the barrel at 220 may include selectively transferring the selected cartridge, or a plurality of cartridges contained within the magazine, in any suitable manner. As an example, the transferring at 220 may include transferring the selected cartridge with, via, and/or utilizing an action of the perforation device. Examples of the action are disclosed herein with reference to action 170 of FIGS. 2-8.

Providing the gas stream to the barrel at 230 may include providing any suitable gas stream to the barrel in any suitable manner. As an example, the providing at 230 may include providing the gas stream with, via, and/or utilizing a gas supply structure that may include a gas source. The gas source may include and/or be a surface gas source. Under these conditions, the providing at 230 also may include conveying the gas stream from the surface gas source to the barrel with, via, and/or utilizing a gas supply conduit, such as coiled tubing. The providing at 230 further may include restricting entry of wellbore fluid into the barrel, flowing the gas stream through the barrel, and/or pressurizing the barrel with the gas stream. This may include pressurizing the barrel to a stream pressure that is greater than an ambient pressure surrounding the perforation device within the downhole conduit. Examples of the gas supply structure are disclosed herein with reference to gas supply structure 90 of FIGS. 1-8.

Locking the selected cartridge within the breech of the barrel at 240 may include selectively locking, securing, and/or retaining the selected cartridge within the breech of the barrel, such as with a lock mechanism of the perforation device and/or of the action. The locking at 240 may be performed subsequent to the transferring at 220 and prior to the firing at 250.

Firing the selected cartridge at 250 may include selectively firing the selected cartridge to accelerate the selected projectile of the selected cartridge from a muzzle of the barrel at a muzzle velocity and with a muzzle trajectory. The firing at 250 may be accomplished in any suitable manner. As an example, and as discussed herein with reference to FIGS. 2-8, the action may include a firing mechanism that may be actuated to fire the selected cartridge. As another example, and as discussed herein with reference to FIG. 9, the selected cartridge may include an igniter and a propellant, and the firing at 250 may include actuating the igniter to ignite the propellant and accelerate the selected projectile from the muzzle of the barrel. The firing at 250 may be performed subsequent to the positioning at 210, subsequent to the transferring at 220, subsequent to the providing at 230, subsequent to the locking at 240, prior to the altering at 260, prior to the penetrating at 270, and/or prior to the removing at 280. Examples of the firing mechanism are disclosed herein with reference to firing mechanism 178 of FIGS. 2-8.

Altering the muzzle trajectory of the selected projectile at 260 may include altering the muzzle trajectory of the selected projectile with, via, and/or utilizing a trajectory-altering structure. This may include altering the muzzle trajectory such that, upon exiting the trajectory-altering structure, the selected projectile has a modified trajectory that differs from the muzzle trajectory. Examples of the muzzle trajectory, the modified trajectory, and/or of modification angles between the muzzle trajectory and the modified trajectory are disclosed herein with reference to muzzle trajectory 136, modified trajectory 142, and modification angle 144, respectively, of FIGS. 2-8.

The altering at 260 may include altering with any suitable trajectory-altering structure. This may include altering with a bent tubular trajectory-altering structure, such as by conveying the selected projectile through the bent tubular. Additionally or alternatively, the altering at 260 also may include altering with a ricochet-inducing structure, such as by ricocheting the selected projectile off the ricochet-inducing structure and/or off a ricochet-inducing surface of the ricochet-inducing structure. The altering at 260 may be performed subsequent to the positioning at 210, subsequent to the transferring at 220, subsequent to the providing at 230, subsequent to the locking at 240, subsequent to the firing at 250, responsive to the firing at 250, prior to the penetrating at 270, and/or prior to the removing at 280.

Penetrating downhole tubing with the selected projectile at 270 may include penetrating the downhole tubing to form and/or define a perforation within the downhole tubing. The perforation may provide fluid communication between the downhole conduit and the subterranean formation. The penetrating at 270 may be performed subsequent to the positioning at 210, subsequent to the transferring at 220, subsequent to the providing at 230, subsequent to the locking at 240, subsequent to the firing at 250, responsive to the firing at 250, subsequent to the altering at 260, and/or prior to the removing at 280.

Removing the selected casing from the breech of the barrel at 280 may include spatially separating the selected casing and the barrel. This may include removing to permit and/or facilitate the repeating at 290. The removing at 280 may be performed subsequent to the positioning at 210, subsequent to the transferring at 220, subsequent to the providing at 230, subsequent to the locking at 240, subsequent to the firing at 250, and/or responsive to the firing at 250.

Repeating at least a portion of the methods at 290 may include repeating any suitable portion of methods 200 in any suitable order. As an example, the perforation may be a first perforation, and the repeating at 290 may include repeating to form and/or define a second, or a subsequent, perforation within the downhole tubing. This may include repeating at least the positioning at 210, the transferring at 220, providing at 230, the firing at 250, and the penetrating at 270 a plurality of times to form a plurality of perforations within the downhole tubing. The repeating the positioning at 210 may include moving the perforation device along the length of the downhole conduit to position the perforation device at a plurality of spaced-apart locations within the downhole conduit, thereby facilitating formation of the plurality of perforations at the plurality of spaced-apart locations. The repeating at 290 further may include selectively rotating at least a portion of the perforation device to define a desired angular perforation distribution within the downhole tubing and/or with the plurality of perforations.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It also is within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The systems and methods disclosed herein are applicable to the well drilling and/or completion industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What we claim is:

1. A perforation device configured to be positioned within a downhole conduit of downhole tubing, which extends within a wellbore that extends within a subterranean formation, and to form a plurality of perforations within the downhole tubing, the perforation device comprising:

a magazine configured to contain a plurality of cartridges;

a barrel extending between a breech, which is configured to receive a selected cartridge of the plurality of cartridges from the magazine, and a muzzle, wherein the selected cartridge includes a selected casing and a selected projectile, and further wherein the muzzle is configured, upon firing of the selected cartridge, to permit the selected projectile to exit the barrel at a muzzle velocity and a muzzle trajectory;

an action configured to selectively and sequentially:

(i) transfer the selected cartridge from the magazine to the breech of the barrel; and (ii) fire the selected cartridge to accelerate the selected projectile through the barrel; and a gas supply structure configured to provide a gas stream to the barrel, wherein the gas supply structure includes:

(i) a surface gas source that is positioned within a surface region; and (ii) a gas supply conduit extending between the surface gas source and the barrel and configured to convey the gas stream from the surface gas source to the barrel.

2. The perforation device of claim 1, wherein the gas supply conduit includes coiled tubing.

3. The perforation device of claim 1, wherein the gas supply structure is configured to provide the gas stream to the barrel to at least one of:

(i) restrict entry of wellbore fluid into the barrel; and (ii) maintain a gaseous environment between the breech of the barrel and the muzzle of the barrel.

4. The perforation device of claim 1, wherein at least one of:

(i) the gas supply structure is configured to provide the gas stream to the breech of the barrel; and (ii) the barrel includes a gas injection port, and further wherein the gas supply structure is configured to provide the gas stream to the gas injection port.

5. The perforation device of claim 1, wherein, when the perforation device is positioned within the downhole conduit, the muzzle trajectory and the downhole tubing define an angle of incidence therebetween, and further wherein the angle of incidence is less than a ricochet angle between the selected projectile and the downhole tubing.

6. The perforation device of claim 1, wherein at least one of:

(i) the magazine is a stack magazine; and (ii) the magazine is a tubular magazine.

7. The perforation device of claim 1, wherein the perforation device further includes a rotation structure configured to selectively rotate at least the barrel, within the downhole conduit, to facilitate formation of the plurality of perforations within the downhole tubing such that the plurality of perforations defines a desired angular perforation distribution.

8. The perforation device of claim 7, wherein the rotation structure is configured to selectively vary an orientation of the muzzle trajectory, relative to the downhole tubing, when the perforation device is positioned within the downhole conduit.

9. The perforation device of claim 1, wherein the perforation device further includes a trajectory-altering structure configured to receive the selected projectile from the muzzle and to act upon the selected projectile such that, upon exiting the trajectory-altering structure, the selected projectile defines a modified trajectory that differs from the muzzle trajectory.

10. The perforation device of claim 9, wherein the trajectory-altering structure includes a bent tubular trajectory-altering structure that extends from the muzzle of the barrel.

11. The perforation device of claim 9, wherein the trajectory-altering structure includes a ricochet-inducing structure configured to direct the selected projectile from the muzzle trajectory to the modified trajectory.

12. The perforation device of claim 1, wherein the perforation device includes the plurality of cartridges, wherein each cartridge in the plurality of cartridges includes:

a casing defining a head, a mouth, and a body extending between the head and the mouth;

a projectile positioned within the mouth;

a propellant contained within the body; and an igniter contained within the head.

13. The perforation device of claim 1, wherein the action is configured to selectively fire the selected cartridge responsive to receipt of a firing signal.

14. The perforation device of claim 13, wherein the firing signal includes at least one of:

(i) an electronic firing signal;

(ii) a mechanical firing signal;

(iii) a wireless firing signal;

(iv) a predetermined pressure pulse sequence within wellbore fluid that surrounds the perforation device within the wellbore; and (v) a predetermined mechanical force sequence applied to the perforation device by an umbilical that extends between the perforation device and the surface region.

15. A method of perforating downhole tubing extending within a wellbore that extends within a subterranean formation, the method comprising:

positioning a perforation device within a downhole conduit, which is defined by the downhole tubing;

providing a gas stream to a barrel of the perforation device with a gas supply structure that includes a surface gas source, wherein the providing the gas stream includes conveying the gas stream from the surface gas source to the barrel via a gas supply conduit; and selectively and sequentially:

(i) transferring a selected cartridge of a plurality of cartridges from a magazine of the perforation device to a breech of a barrel of the perforation device;

(ii) firing the selected cartridge to accelerate a selected projectile of the selected cartridge from a muzzle of the barrel at a muzzle velocity and a muzzle trajectory; and (iii) penetrating the downhole tubing with the selected projectile to form a perforation in the downhole tubing.

16. The method of claim 15, wherein the positioning includes flowing the perforation device from a surface region and in a downhole direction within the downhole conduit.

17. The method of claim 15, wherein the providing the gas stream includes at least one of:

(i) restricting entry of wellbore fluid into the barrel;

(ii) flowing the gas stream through the barrel; and (iii) pressurizing the barrel, with the gas stream, to a stream pressure that is greater than an ambient pressure surrounding the perforation device within the downhole conduit.

18. The method of claim 15, wherein the gas supply conduit includes coiled tubing.

19. The method of claim 15, wherein the perforation is a first perforation, and further wherein the method includes repeating at least the positioning, the providing, the transferring, the firing, and the penetrating a plurality of times to form a plurality of perforations in the downhole tubing.

20. The method of claim 19, wherein, during the repeating, the method further includes selectively rotating at least the barrel to define a desired angular perforation distribution with the plurality of perforations.

* * * * *